United States Patent [19]

Mueller

[11] Patent Number: 4,818,197

[45] Date of Patent: Apr. 4, 1989

[54] PROGESSIVE CAVITY PUMP

[75] Inventor: James W. Mueller, Duncan, Okla.

[73] Assignee: Halliburton Company, Duncan, Okla.

[21] Appl. No.: 4,503

[22] Filed: Jan. 20, 1987

[51] Int. Cl.[4] ..... F04C 2/107; F04C 5/00

[52] U.S. Cl. ..... 418/48; 418/153

[58] Field of Search ..... 418/48, 153, 182

[56] References Cited

U.S. PATENT DOCUMENTS

| | | | |
|---|---|---|---|
| 2,532,145 | 11/1950 | Byram | 418/182 |
| 2,765,114 | 10/1956 | Chang | 418/48 |
| 2,826,152 | 3/1958 | Michie | 418/48 |
| 2,862,454 | 12/1958 | Alcock | 418/48 |
| 3,084,631 | 4/1963 | Bourke | 418/48 |
| 3,104,615 | 9/1963 | Szegvari | 418/48 |
| 3,139,035 | 6/1964 | O'Connor | 418/48 |
| 3,216,768 | 11/1965 | Soeding | 418/48 |
| 3,354,537 | 11/1967 | O'Connor | 418/48 |
| 3,771,906 | 11/1973 | Bourke | 418/153 |
| 3,838,949 | 10/1974 | Makino | 418/153 |
| 3,932,072 | 1/1976 | Clark | 418/48 |

FOREIGN PATENT DOCUMENTS

| | | | |
|---|---|---|---|
| 223335 | 5/1987 | European Pat. Off. | 418/48 |
| 2619751 | 11/1977 | Fed. Rep. of Germany | 418/153 |
| 2937403 | 4/1981 | Fed. Rep. of Germany | 418/153 |
| 3119568 | 12/1982 | Fed. Rep. of Germany | 418/153 |
| 446291 | 4/1936 | United Kingdom | 418/48 |
| 740485 | 11/1955 | United Kingdom | 418/48 |

OTHER PUBLICATIONS

Catalog CP-8400 published by Continental Pump Company, 11811 Westline Industrial Drive, St. Louis, Missouri 63146.

Ramoy Progressive Cavity Pump Catalog of Robbins & Myers, Inc., Fluid Handling Division, Post Office Box 463, Columbia, South Carolina 29202.

*Primary Examiner*—John J. Vrablik

*Attorney, Agent, or Firm*—James R. Duzan; Neal R. Kennedy

[57] ABSTRACT

A progressive cavity pump capable of operating at both high and low system pressures. The pump includes a housing with an elastomeric stator disposed therein. A rotor is rotatably and pumpingly disposed in a pumping chamber defined by the stator. A support member is disposed annularly between inner and outer portions of the stator, and the member bears longitudinally against an annular end portion of the stator and a facing annular shoulder in the housing such that deformation of the stator is prevented when high inlet pressures are present.

7 Claims, 3 Drawing Sheets

PROGESSIVE CAVITY PUMP

BACKGROUND OF THE INVENTION

1. Field of the Invention

This invention relates to progressive cavity pumps having elastomeric stators, and more particularly, to such a pump having stator supporting means for preventing deformation of the stator under high system pressure conditions.

2. Description of the Prior Art

The present invention is a modified version of known progressive cavity pumps. The prior art pumps include a housing with a substantially elastomeric stator therein and a screw-type rotor rotatably disposed within the stator. As the rotor rotates, fluid is forced therealong through a pumping chamber in the stator and toward the pump outlet.

A problem with these previously known progressive cavity pumps is that under relatively high system pressure conditions, the stator grippingly engages the rotor with such force that the stator may be deformed axially in a direction away from the pump suction port as the rotor turns. When this occurs, pumping action is adversely affected or stopped altogether. Thus, such pumps have not been usable under high pressure conditions.

The present invention solves this problem by providing stator support means which prevents movement and deformation of the stator even when the pressure in the pump is relatively high.

SUMMARY OF THE INVENTION

The progressive cavity pump of the present invention comprises a housing having inlet means and outlet means thereon, a stator disposed in the housing adjacent the inlet means and defining a pumping chamber therethrough in fluid communication with the inlet means and outlet means and having an elastomeric portion, a rotor rotatably disposed in the pumping chamber of the stator, and stator support means for supporting the stator and preventing deformation of the elastomeric portion thereof in response to fluid pressure in the housing and rotation of the rotor. The housing includes a first and second housing portion defining an axis therethrough. Preferably, the inlet means is characterized by an inlet or suction port in the first housing portion substantially coaxial with the pumping chamber, and the outlet means is characterized by an outlet or discharge port in the second housing portion which extends substantially transversely with respect to the axis of the pump.

The stator is preferably integrally molded of an elastomeric material, such as rubber. The pumping chamber includes a plurality of annular cavities or indentations therein which are axially spaced therealong. The rotor has a rounded screw-type helical surface which, when rotated about the housing axis, forces fluid to be moved axially along the cavities in the pumping chamber.

The stator support means is best characterized by an elongated member having a first end bearing against the stator and a second end opposite the first end and bearing against an annular shoulder in the second housing portion which generally faces the inlet means. In the preferred embodiment, the elongated member is characterized by a sleeve of substantially cylindrical configuration. At least one transverse hole is defined therethrough which is in fluid communication with the outlet means. The sleeve holds the stator in position and prevents the stator from moving axially along the rotor as the rotor turns even when the system pressure in the pump is relatively high.

An important object of the invention is to provide a modified progressive cavity pump which will operate at both high and low system pressures.

Another object of the invention is to provide a stator support means for an elastomeric stator in a progressive cavity pump.

A further object of the invention is to provide a progressive cavity pump with a member disposed therein for preventing deformation of an elastomeric stator under high pressure conditions.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1:
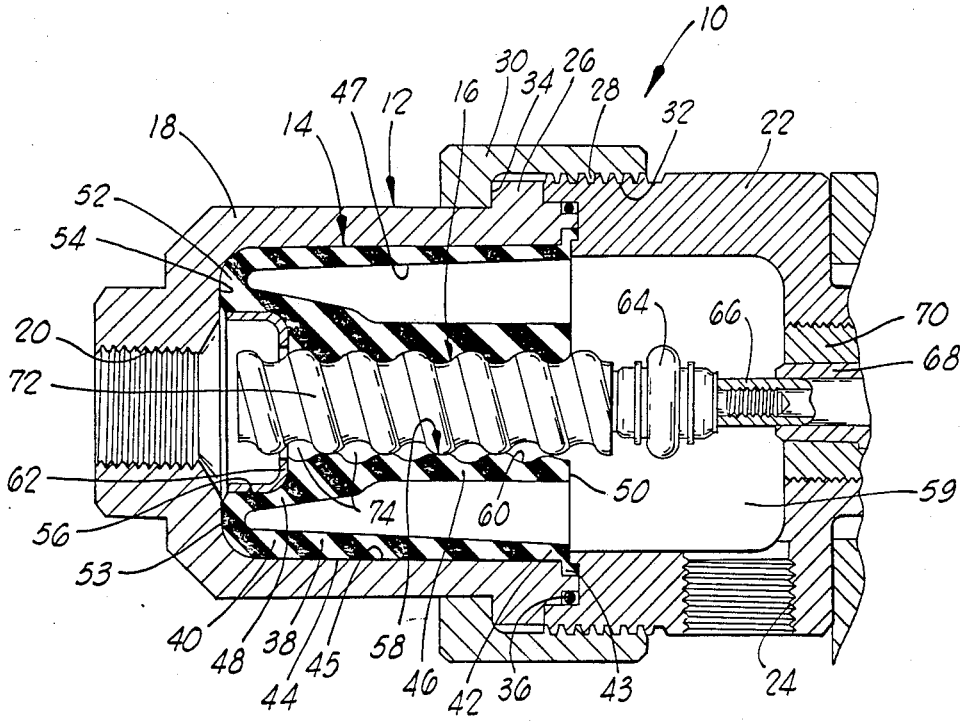
FIG. 1 PRIOR ART
FIG. 1 is a longitudinal cross section of a prior art progressive cavity pump shown in a normal operating condition.
Figure 2:
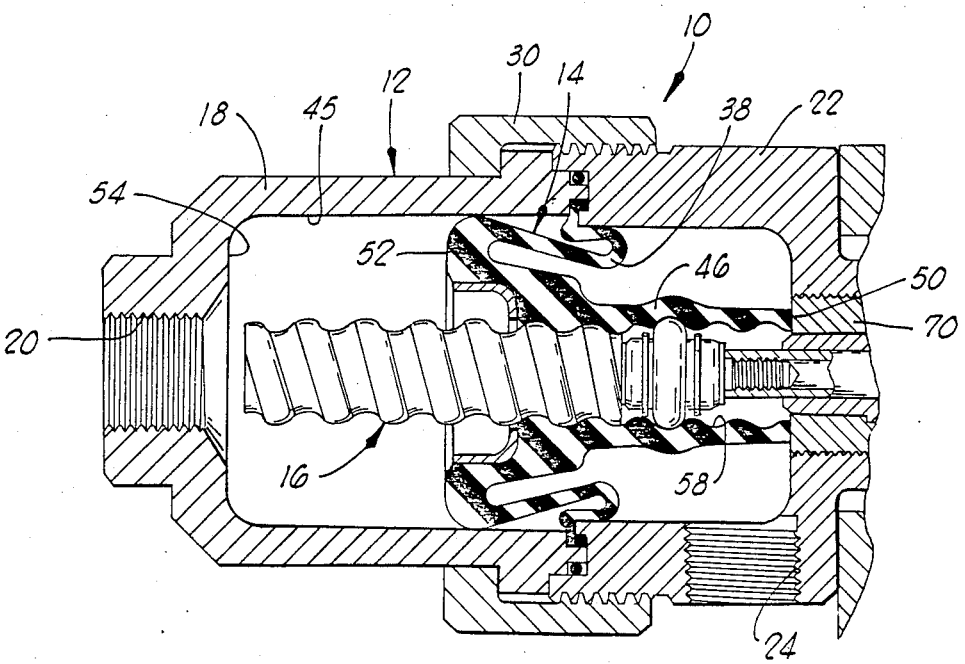
FIG. 2 PRIOR ART
FIG. 2 illustrates the prior art pump of FIG. 1 wherein an elastomeric stator therein has been deformed in a direction away from the inlet.

Referring now to the drawings, and more particularly to FIGS. 1 and 2, a prior art progressive cavity pump is shown and generally designated by the numeral 10. The major components of pump 10 include a housing 12, a stator 14 and a rotor 16.

Housing 12 includes a first, inlet or suction housing portion 18 defining inlet means thereon, preferably in the form of an inlet or suction port 20 and a second, discharge or outlet portion 22 defining outlet means thereon, preferably in the form of an outlet or discharge port 24. Preferably, suction port 20 is coaxial with housing 12, and discharge port 24 extends transversely with respect to the axis of the housing. However, progressive cavity pumps are not specifically limited to such a configuration.

In prior art pump 10, first housing portion 18 includes an outwardly extending annular flange portion 26 which is disposed adjacent an externally threaded portion 28 of second housing portion 22. An annular lock ring 30 has an internally threaded portion 32 engaged with threaded portion 28 on second housing portion 22 and a shoulder portion 34 which engages flange 26 on first housing portion 18, thus providing a clamping means for clamping the first and second housing portions together. Sealing means, such as O-ring 36, insures sealing engagement between first housing portion 18 and second housing portion 22.

Stator 14 includes an annular outer portion 38 having a first end 40 and an opposite second end 42 spaced from the first end. Second end 42 of outer portion 38 includes a radially outwardly extending annular lip 43 which is clamped between first housing portion 18 and second housing portion 22. It will be seen that outer surface 44 of outer portion 38 is molded to conform to inner surface 45 of first housing portion 18.

Stator 14 also includes an inner portion 46 having an enlarged first end 48 and a second end 50 spaced from the first end. Inner portion 46 is spaced radially inwardly from inner surface 47 of outer portion 38 and is substantially coaxial with outer portion 38.

Stator 14 further includes an annular end portion 52 which interconnects first end 40 of outer portion 38 and first end 48 of inner portion 46. Outer surface 53 of end portion 52 generally conforms to annular shoulder 54 of first housing portion 18. Preferably, outer portion 38, inner portion 46 and end portion 52 of stator 14 are integrally molded from an elastomeric material, such as rubber.

Inner portion 46 of stator 14 defines a suction chamber 56 therein adjacent suction port 20 and further defines an axially extending pumping chamber 58 therethrough. It will be seen that pumping chamber 58 is in fluid communication at one end with suction chamber 56, and thus with suction port 20, and also in fluid communication at the outer end with discharge chamber 59 in second housing portion 22, and thus with discharge port 24. The surface defining pumping chamber 58 is corrugated such that a plurality of helical threads 60 are defined therealong.

Some pumps include a reinforcing cup 62 disposed in suction chamber 56 of stator 14, although this is not necessary in all circumstances. Reinforcing cup 62 is provided for preventing deformation of stator 14 toward suction port 20 when fluid pressure is present in discharge chamber 59. Under relatively high differential pressure conditions, stator 14 can be extruded into suction port 20 unless reinforcing cup 62 is present.

Rotor 16 comprises an elongated member which is disposed through pumping chamber 58 of stator 14 and is substantially coaxial with stator 14 and housing 12. A coupling 64 connects one end of rotor 16 with a drive shaft 66 rotated by a prime mover (not shown). In the embodiment shown, drive shaft 66 is supported by a bearing or bushing 68 which is carried in second housing portion 22 by a bearing carrier 70. Sealing means of a kind known in the art (not shown) prevent leakage of fluid out of discharge chamber 59 past drive shaft 66 and bearing 68.

The outer surface of rotor 16 defines a rounded, substantially helical screw-type threaded surface 72. The interaction of threaded surface 72 with threads 60 in pumping chamber 58 form a plurality of cavities 74 spaced along the length of the pumping chamber.

In normal operation, rotor 16 is rotated about the pump axis in pumping chamber 58 by the prime mover through drive shaft 66. Because of threaded surface 72 of rotor 16, fluid entering suction chamber 56 through suction port 20 is forced into the cavity 74 nearest the suction port. In a manner known in the art, the fluid is progressively moved from cavity to cavity and discharged into discharge chamber 59 in second housing portion 22, hence the term "progressive cavity pump". In the normal operating configuration of FIG. 1, stator 14 has sufficient strength to remain in position during the pumping operation.

A major problem with progressive cavity pumps occurs when such pumps are used in relatively high system pressure situations. In such cases, the inherent strength of stator 14 is not sufficient to withstand the pressure acting thereon. When this occurs, inner portion 46 of stator 14 is deformed toward rotor 16, essentially clamping the stator inner portion to the rotor. This tightly gripping action of inner portion 46 of stator 14 on rotor 16 causes the stator inner portion to conform to threaded surface 72 on the rotor. Because rotor 16 is longitudinally fixed, rotation of the rotor will "screw" inner portion 46 of stator 14 away from suction port 20, thus axially deforming stator 14 toward second housing portion 22. Typically, this deformation results in outer portion 38 of stator 14 being buckled, as shown in FIG. 2. Annular end portion 52 of stator 14 is thus moved away from shoulder 54 in first housing portion 18, and generally second end 50 of inner portion 46 of stator 14 is pushed against a surface in second housing portion 22, such as bearing carrier 70. Obviously, with stator 14 in this position, suction port 20 and discharge port 24 are substantially sealingly separated. Even if fluid can pass around second end 50 of stator inner portion 46, the major portion of rotor 16 is no longer engaged with pumping chamber 58, and thus there is a great loss of efficiency. The result is that, for all practical purposes, pump 10 is no longer operative.

Figure 3:
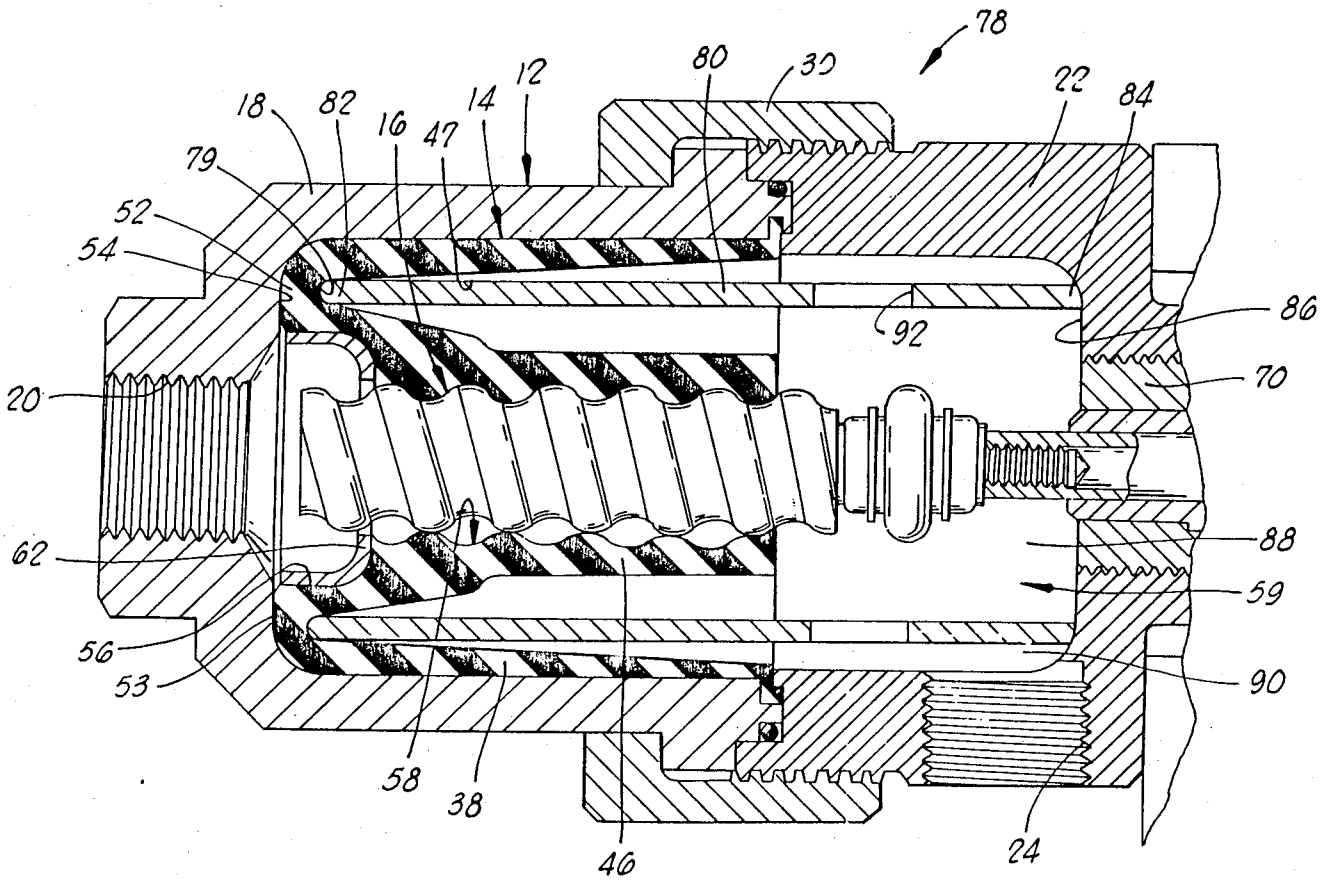
FIG. 3 is a longitudinal cross section of the improved progressive cavity pump of the present invention.

Referring now to FIG. 3, the progressive cavity pump of the present invention which solves this prior art problem is shown and generally designated by the numeral 78. Pump 78 is substantially identical to prior art pump 10 except that it includes stator support means for supporting stator 14 and preventing deformation thereof. The stator support means is best characterized by an elongated member, such as a sleeve 80, which is annularly positioned between outer portion 38 and inner portion 46 of stator 14.

In the embodiment of FIG. 3, sleeve 80 is substantially cylindrical and has a first end 82 adapted to bear against inner surface 79 of annular end portion 52 of stator 14. Sleeve 80 has a second end 84 opposite first end 82 which bears against annular shoulder 86 in second housing portion 22. It will thus be seen that sleeve 80 extends into discharge chamber 59 and divides the discharge chamber into an inner portion 88 and an annular outer portion 90. Sleeve 80 defines at least one transverse hole 92 therethrough so that fluid communication is maintained between inner portion 88 and outer portion 90, and thus between pumping chamber 58 of stator 14 and discharge port 24.

The length of sleeve 80 is dimensioned such that when first housing portion 18 is clamped to second housing portion 22 by lock ring 30, annular end portion 52 of stator 14 is pressed against annular shoulder 54 in the first housing portion. Thus, even though relatively high system pressures may be present, sleeve 80 prevents deformation of elastomeric stator 14 toward second housing portion 22 as rotor 16 turns. Thus, a progressive cavity pump is provided which will operate at both high and low system pressures.

Figure 4:
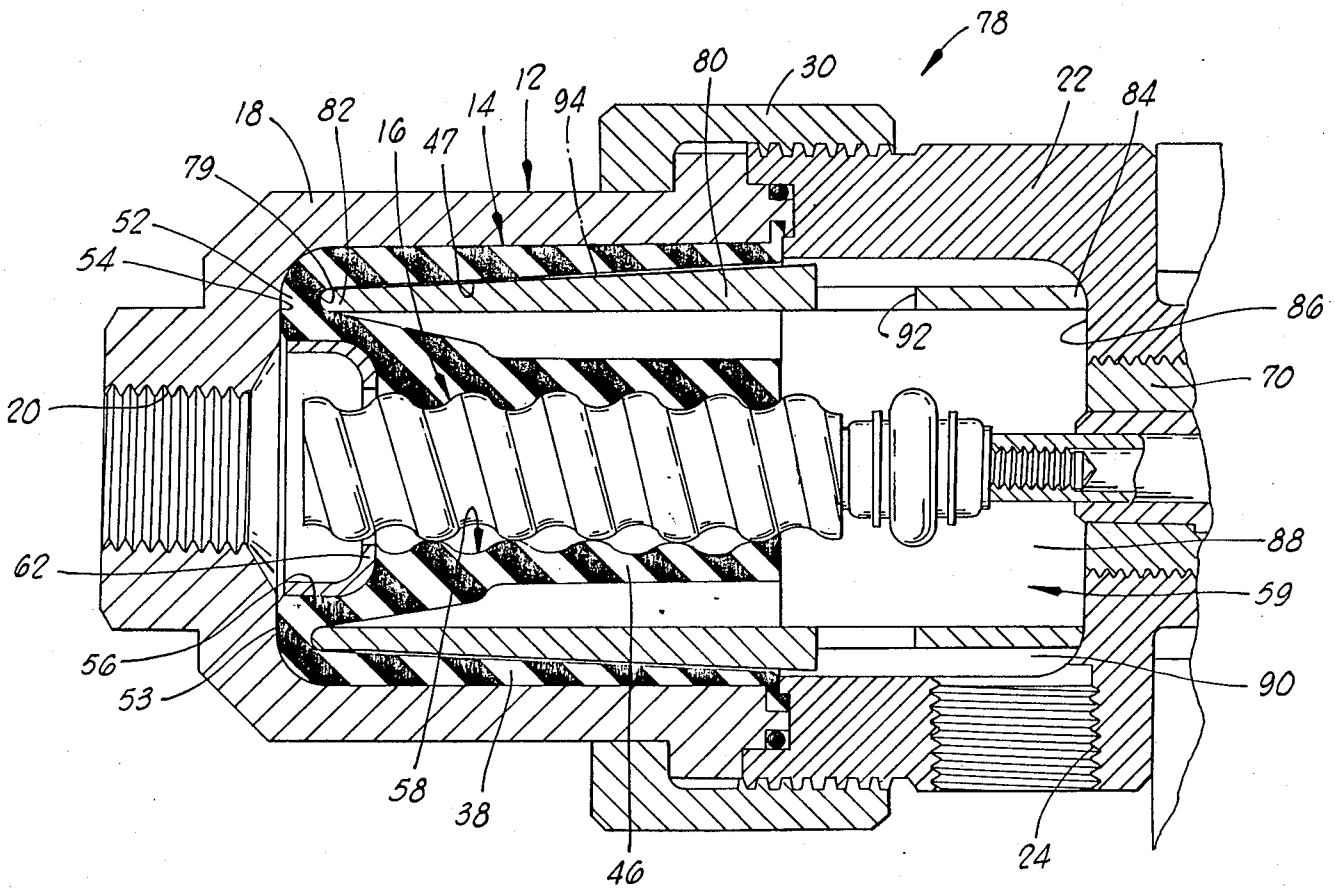
FIG. 4 is a longitudinal cross section of another form of the invention.

Although the stator support means is illustrated in the form of a cylindrical sleeve 80, the invention is not intended to be limited to such a configuration. For example, as shown in FIG. 4, an outer surface 94 of the stator support means is shaped such that it conforms to inner surface 47 of outer portion 38 of stator 14, thus providing additional support to the outer portion.

It will be seen, therefore, that the progressive cavity pump of the present invention is well adapted to carry out the ends and advantages mentioned, as well as those inherent therein. While a presently preferred embodiment of the apparatus has been shown for the purposes of this disclosure, numerous changes in the arrangement and construction of parts may be made by those skilled in the art. All such changes are encompassed within the scope and spirit of the appended claims.

What is claimed is:

1. A progressive cavity pump comprising:

a first housing portion defining an inlet therethrough;

a second housing portion attachable to said first housing portion and defining an outlet therethrough;

a substantially elastomeric stator comprising:

an outer portion removably attached to said first and second housing portions having a first end and a second end spaced from said first end;

an inner portion defining a pumping chamber therethrough and having a first end and a second end spaced from said first end of said inner portion; and an annular end portion interconnecting said first ends of said outer and inner portions;

a rotor disposed in said inner portion of said stator and extending through said pumping chamber for pumping fluid from said inlet to said outlet in response to rotation of said rotor; and an elongated member disposed in said housing portions and generally annularly between said inner and outer portions of said stator and longitudinally between said annular end portion of said stator and a portion of said second housing portion, said member being removable from said housing portions and separable from said stator.

2. The pump of claim 1, wherein said member is a substantially cylindrical sleeve.

3. The pump of claim 1, wherein said member defines at least one transverse fluid communication therethrough.

4. The pump of claim 1, wherein said second end of said outer portion of said stator includes an annular lip thereon clamped between said first and second housing portions.

5. The pump of claim 1, further comprising a drive shaft extending through said second housing portion and drivingly attached to said rotor for rotation thereof.

6. The pump of claim 1, wherein said portion of said second housing portion against which said member bears is a substantially annular surface generally facing said inlet.

7. The pump of claim 1, wherein an outer surface of said member is dimensioned to conform to an inner surface of said outer portion of said stator.

* * * * *

UNITED STATES PATENT AND TRADEMARK OFFICE

CERTIFICATE OF CORRECTION

PATENT NO. : 4,818,197

DATED : April 4, 1989

INVENTOR(S) : James W. Mueller

It is certified that error appears in the above-identified patent and that said Letters Patent is hereby corrected as shown below:

On the title page, item [54] and in column 1, in the title "PROGESSIVE" should read --PROGRESSIVE--.

On the title page, line 10 of the ABSTRACT, "inlet" should read --outlet--.

In column 6, line 8, insert the word --hole-- after "communication".

Signed and Sealed this

Fourteenth Day of November, 1989

*Attest:*

JEFFREY M. SAMUELS

*Attesting Officer*

*Acting Commissioner of Patents and Trademarks*